US006334488B1

(12) United States Patent
Freiheit

(10) Patent No.: US 6,334,488 B1
(45) Date of Patent: Jan. 1, 2002

(54) TUBING PLUG

(75) Inventor: Roland Richard Freiheit, Edmunton (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/480,638

(22) Filed: Jan. 11, 2000

(51) Int. Cl.[7] ..... E21B 34/00
(52) U.S. Cl. ..... 166/192; 166/142
(58) Field of Search ..... 166/192, 387, 166/123, 117, 117.6, 135, 142

(56) References Cited

U.S. PATENT DOCUMENTS

| | | | | | |
|---|---|---|---|---|---|
| 3,687,202 | A | * | 8/1972 | Young et al. | 166/299 |
| 4,178,992 | A | | 12/1979 | Regan et al. | |
| 4,429,741 | A | * | 2/1984 | Hyland | 166/63 |
| 4,609,005 | A | | 9/1986 | Upchurch | 137/68.1 |
| 4,651,818 | A | | 3/1987 | Johnson et al. | |
| 4,984,631 | A | | 1/1991 | Reesing | |
| 5,343,956 | A | * | 9/1994 | Coronado | 166/387 |
| 5,366,010 | A | * | 11/1994 | Zwart | 166/120 |
| 5,441,111 | A | | 8/1995 | Whiteford | |
| 5,464,063 | A | | 11/1995 | Boehm, Jr. | |
| 5,509,476 | A | | 4/1996 | Vick, Jr. | |
| 5,542,475 | A | | 8/1996 | Turner et al. | |
| 5,685,372 | A | | 11/1997 | Gano | |
| 5,727,632 | A | * | 3/1998 | Richards | 166/387 |
| 5,765,641 | A | | 6/1998 | Shy et al. | |
| 5,979,553 | A | * | 11/1999 | Brink | 166/250.08 |

* cited by examiner

*Primary Examiner*—Frank Tsay
(74) *Attorney, Agent, or Firm*—Moser, Patterson & Sheridan, L.L.P.

(57) ABSTRACT

A bi-directional plug blocks the flow of fluid through a flow bore of a tubing string and can be opened by simple mechanical means requiring no external tools. A piston is slidably mounted in a piston housing and fixed in a first position with a plurality of shear screws. An atmospheric chamber formed within the piston housing creates a pressure differential causing the shear screws to fail when a certain pressure is applied to the surface area of the piston. When the shear screws break, the piston accelerates and strikes a scored, dome-shaped plug. The piston penetrates the plug, permanently pressing and housing pieces of the plug against the wall of a plug housing and opening the flow bore of the plug to fluid.

12 Claims, 3 Drawing Sheets

TUBING PLUG

BACKGROUND OF THE INVENTION

1. Field of the Invention

The present invention relates to plugs for use in subterranean wells. More particularly, the invention relates to plugs used to block the flow of production fluid through the flow bore of a tubing string in a well.

2. Background of the Related Art

In well completion, it is often necessary to block the flow of liquids in the flow bore of a tubing string in order to isolate the upper portion of the tubing string from production fluids. Some tubing plugs are retrievable and are typically run into the tubing on coil tubing or cable and are then removed in the same way. Other tubing plugs are installed between adjacent pieces of tubing and lowered into the wellbore with the tubing string. Removal of these plugs requires either that the entire tubing string be pulled from the well or that the plugs be remotely opened when fluid flow through the flow bore is desired.

One type of plug installed between pieces of tubing string includes a central frangible element that can be either pierced or smashed by mechanical means. An example includes a one-piece frangible ceramic sealing element which, after use, is shattered by impacting with a tooth-faced, blind box hammer under force of gravity. In each of these cases, the remaining pieces of the seal must be washed out of the wellbore with completion fluid or the like making these designs unsuitable for many customers. Additionally, some designs which use a mechanical impact means to destroy the flow blocking element require an additional tool run on wire line or coil tubing to lower and then remove the impact means.

Other plugs installed between pieces of tubing are opened remotely through precise pulses of pressure which either destroy the seal element or actuate some valve located on the plug, thereby opening the sealing surface to flow. In still other instances, the plugs are destroyed with an explosive detonation also leaving bits of debris in the well which must be removed.

Also known in the art are temporary plugs made with a compressed mixture of salt and sand. These plugs may be rapidly dispersed, essentially in their entirety, by exposure of the salt and sand mixture to a wellbore fluid. However, these systems generally have been configured to block pressurized fluid from only one direction, usually downward, from the earth's surface and are therefore useful only in one direction. Another known plug assembly includes the plug member which has a frangible or dome-shaped portion shaped in a arcurate fashion, whereby one side of the plug presents a convex surface and another side presents a concave surface. The dome configuration of these plugs typically causes the plug member to be significantly more resistant to pressure from its convex side than its concave side. Consequently, these plugs are also practically capable of blocking fluid pressure from only a single direction.

From the foregoing it can be seen that it would be desirable to provide a plug which can be installed between pieces of tubing and which can be remotely opened without leaving debris in the wellbore. Additionally, it would be desirable to provide a plug which can be opened remotely without the use of special tools either at the earth's surface or lowered into the wellbore to the plug. Additionally, it would be desirable to have a plug which can be opened without the use of explosives or complicated pulses of pressure from the earth's surface. Finally, it would be desirable to have a dome-shaped plug which effectively withstands pressure from two directions and does not present a threat of destruction if significant fluid pressure is placed on its concave side.

SUMMARY OF THE INVENTION

A bi-directional plug is provided which blocks the flow of fluid through a flowbore of a tubing string and can be opened by simple mechanical means, requiring no external tools. In one aspect of the invention, a piston is slidably mounted in a piston housing and fixed in a first position with a plurality of shear screws. A chamber formed within the piston housing creates a pressure differential causing the shear screws to break when a, certain pressure is applied to the surface area of the piston. When the shear screws fail, the piston accelerates towards an extended position and strikes a scored, dome-shaped plug. The piston penetrates the plug, permanently pressing and housing pieces of the plug against the wall of a plug housing and opening the flow bore of the plug to fluid in either direction.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
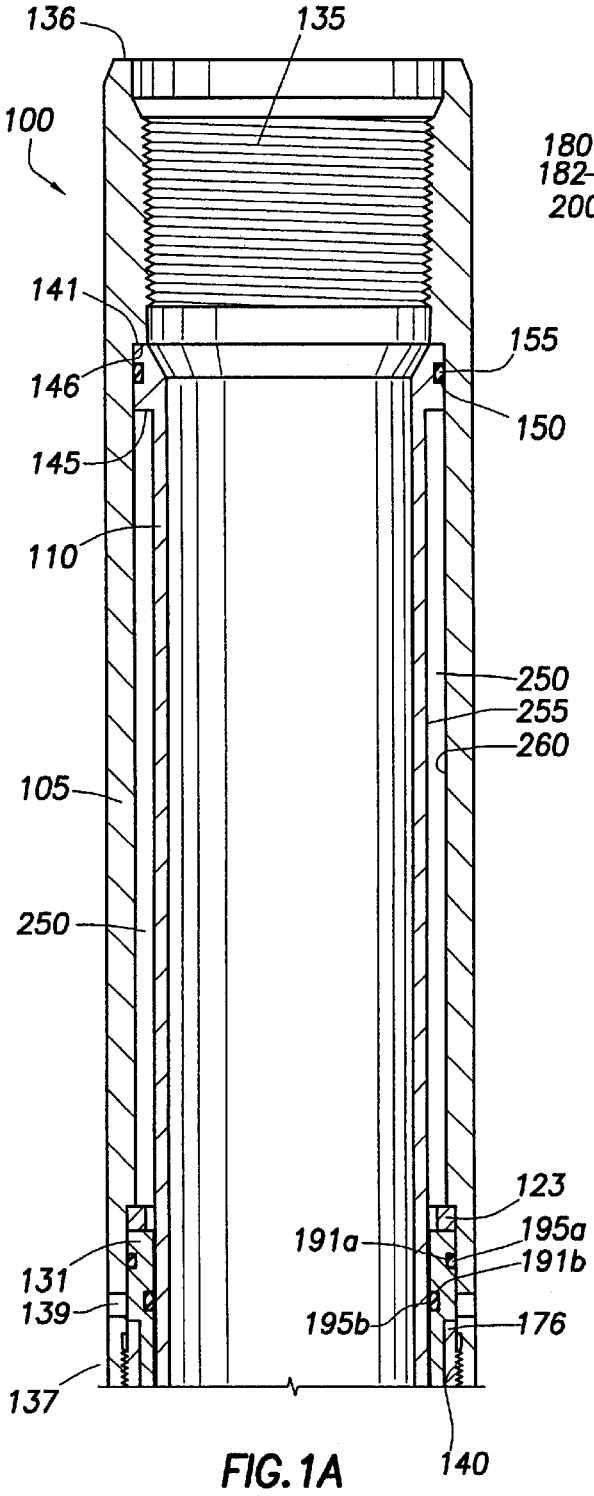
FIG. 1A is a side view of a first end the tubing plug of the present invention, partially in section with the piston in a retracted position.
Figure 1B:
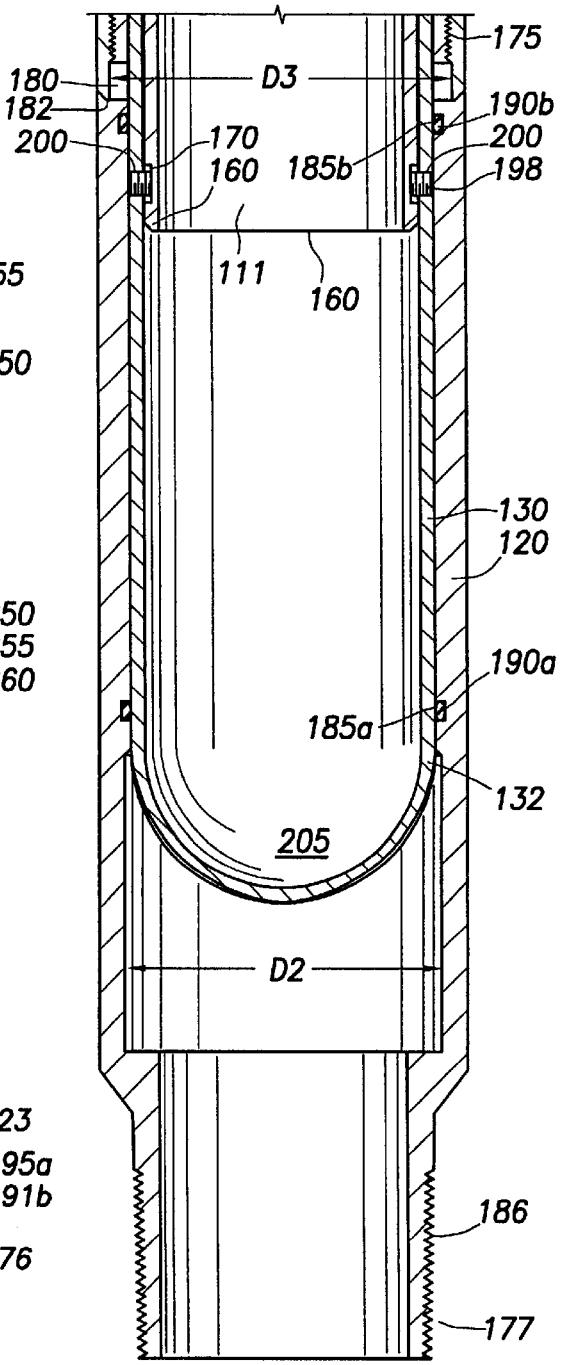
FIG. 1B is a side view, partially in section of the second end of the tubing plug.

The present invention is best described by reference to the drawings. FIGS. 1A & 1B are side views, partially in section of the assembled tubing plug 100. For the purposes herein, the terms casing, liner and tubing are used interchangeably. The assembly is divided into two drawings to better illustrate the various parts thereof. The assembly includes a piston housing 105; an actuating member or annular piston 110 slidably mounted in the piston housing; a plug housing 120 disposed at one end of the piston housing; a chamber 250 formed between the piston 110 and the piston housing 105; a plug 130 disposed within the plug housing; and a bearing ring 123 mounted in the interior of the piston housing. The piston housing 105 has internal threaded connection means 135 at a first end 136 for connection to an adjacent length of tubing (not shown) and an internal threaded area 140 at a second end 137 for connection to the plug body 120. Formed adjacent to the second end 137 of piston housing 105 are set screw holes 139. Set screw holes 139 are constructed and arranged to house threaded set screws (not shown) that extend through piston housing 105 and contact a first end 131 of plug 130. The purpose of the set screws is to rotationally, and axially fix piston housing 105 to plug 130 to facilitate access to shear screws 198 as will be described herein. Also formed at the second end 137 of piston housing 105 is an area of enlarged inside diameter D3.

Figure 3:
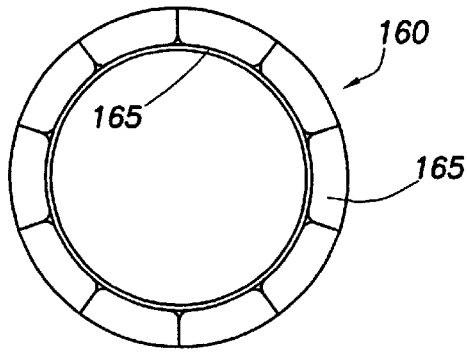
FIG. 3 is an end view of the piston.

In the preferred embodiment, piston 110 is slidably mounted in the interior of piston housing 105. The piston includes a first end 141 with an outwardly extending shoulder 145, the shoulder having a groove 150 formed therein to house an O-ring 155. O-ring 155 seals the annular area between the shoulder 145 and the interior surface 260 of piston housing 105. A second end 111 of the piston 110, most clearly visible in FIG. 3, terminates in an edge 160 having a flat surface 162 and a tapered, grooved surface 165 formed thereon. Piston edge 160 with its flat surface 162 and tapered, grooved surface 165 is designed to strike and open a scored dome 205 as will be described herein. Formed on the outside surface of piston 110 adjacent edge 160 are a plurality of countersunk or spot faces 170 constructed and arranged to form seats for shear screws 198 as will be described herein.

The plug housing 120, includes externally formed threads 175 at a first end 176 for threaded connection to the piston housing 105. A second end 177 of the plug housing 120 has an external threaded area 186 for connection to an adjacent piece of tubing (not shown). A plurality of access apertures 180 are equally spaced around the perimeter of the first end 176 of the plug housing 120. First and second grooves 185*a,b* are formed in the interior of the plug housing for retaining o-ring seals 190*a,b*. O-ring seals 190*a,b* seal the annular area between the interior surface of the plug housing 120 and the exterior surface of plug 130. Also formed in plug housing 120 is an enlarged interior diameter D2 at a second end thereof.

A separate shoulder ring 123 is housed at the first end of the plug 131 and provides a landing for the piston shoulder 145 as described below. In the preferred embodiment, the shoulder ring is separate and can be made of high strength steel while the piston housing is constructed of alloy steel.

Plug 130 includes at a first end 131, an externally formed groove 191 a for retention of an O-ring 195*a* and an internally formed groove 191*b* for retention of an O-ring 195*b*. O-rings 195*a,b* seal the annular area between the plug 130 and the piston housing 105 and the annular area between the plug 130 and the/piston 110, respectively. A plurality of apertures 200 are equally spaced around the perimeter of the plug 130. The apertures 200 are constructed and arranged to align with the spot faces 170 formed in the outer surface 255 of piston 110 as shown in FIG. 1B.

In the preferred embodiment, the plug assembly provides a means of accessing and adjusting the shear screws 198 located in the apertures 200 formed in the plug 130. Because the piston housing 105 is fixed to the plug 130 by set screws and because the piston 110 is fixed to the plug 130 by shear screws 198, all three of the components can be rotated together with respect to the plug housing 120 as the piston housing 105 is unthreaded from the plug housing 120. As the housings 105, 120 separate, the shear screws 198 become visible and accessible through the access holes 180. In this manner, the shear screws 198 can be adjusted or replaced to meet the needs of a particular customer or the characteristics of a particular well. The housings can then be threaded back together, covering the shear screws 198. The back angle formed at the second end 137 of the piston housing 105 and the back angle of the first end 176 of the plug housing 120 allow for a torsion lock when recommended tubing make-up torque is applied when tightening the piston/plug housing together. These mating surfaces 182 are shown in FIG. 1B.

Figure 2:
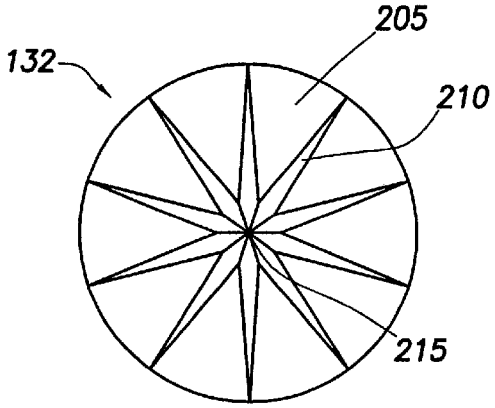
FIG. 2 is an end view of the dome portion plug.

At a second end 132, the plug includes a dome portion 205 which is visible in section in FIG. 1B. The dome portion 205 is also visible in FIG. 2, an end view of the second end 132 of the plug 130. The exterior or convex portion of the dome portion 205 includes scores 210 formed therein and extending from the top to the bottom or side of the dome. Each score 210 originates at an apex 215 of the dome and, in the preferred embodiment, becomes narrower and shallower as it approaches the side of the dome. The scores 210 are specifically formed to allow the dome portion to be broken outward along the scores as will be described below. In the preferred embodiment, the dome portion is made of an aluminum alloy and the scores are created by rotating a convex mill about a center point located on the centerline of the dome portion 205. The plunge depth of the convex mill into the dome and the radius of the cutting path thereupon determines a variable or constant depth of the score 210 as it is machined into the dome. The characteristics of the dome portion regarding its resistance to pressure and likelihood of breaking open along the scores 210, is determined by the depth and number of the scores along the dome.

Describing the parts of the plug assembly 100 and their relationship to one another, FIG. 1 depicts the assembly with the piston 110 in a fully retracted position, wherein the shoulder 145 of the piston 110 is in contact with shoulder 146 formed in the interior of the piston housing 105. Fluid is prevented from entering the plug from the well surface by O-ring seal 155 located between the piston 110 and the piston housing 105. Fluid is prevented from entering the downhole end of the plug by O-ring seal 190*a* located between the plug 130 and the plug body 120. Annular chamber 250 is formed between the exterior surface 255 of the piston 110 and the interior surface 260 of the piston housing 105. Because the tubing plug 100 is assembled at the earth's surface, the chamber 250 contains air at one atmosphere and, because it is sealed at each end by O-rings 155, 195*a* and 195*b*, the chamber will remain at one atmosphere regardless of its location in the well. The pressure in chamber 250 is preferably atmospheric, but can be a different pressure up to the pressure present in the tubing.

The piston is held in its retracted position by the shear screws 198 located in the threaded apertures 200 formed in the plug 130 which extend through the plug and seat in the aligned, counter sunk spaces 170 formed in the outer surface 255 of the piston 110. The alignment of the apertures 200 with the countersunk spaces of the piston ensures that the edge 160 of the piston 110 is in the preferred alignment with the scores 210 in the dome portion 205.

The plug of the present invention is designed with a differential between the well tubing pressure and the pressure in the atmospheric chamber 250 of the plug 100. The differential ensures that when pressure is applied to the piston from the surface of the well, the piston is urged downward towards the dome portion 205 of the plug. The surface area of the piston, or that area acted upon by pressure from above, can be calculated. Assuming, for example, a piston having an outside diameter of 3.14" and an inside diameter of 2.715", the piston area is calculated as follows:

The plug of the present invention is designed with a differential between the well tubing pressure and the pressure in the atmospheric chamber 250 of the plug 100. The differential ensures that when pressure is applied to the piston from the surface of the well, the piston is urged downward towards the dome portion 205 of the plug The surface area of the piston, or that area acted upon by pressure from above, can be calculated. Assuming, for example, a piston having an outside diameter of 3.14" and an inside diameter of 2.715", the piston area is calculated as follows:

$$\text{Piston Area } (Ap)=\{pi\times(3.14/2)^2-(pi\times(2.715/2)^2\}=1.954 \text{ in.}^2$$

With a known piston area and a known pressure applied to the piston area, the force applied to the piston, or piston force Fp can also be calculated as follows:

$$\text{Piston Force } (Fp)=1500 \text{ psi}\times 1.954 \text{ in.}^2=2{,}933 \text{ lbs.}$$

The force applied to the piston to cause the shear screws to break is that force needed to overcome the resisting force of the shear screws and the shear screws can be selected to break at a desired force. In the present example, the shear screws would be designed to fail at a force of no more than 2,933 lbs. This force can be brought to bear by the pressure of fluid in the tubing string above the plug and by additional pressure applied to fluid in the tubing string at the surface of the well. When the piston force exceeds the resistance force of the shear screws, the shear screws fail. Since the hydrostatic pressure acting on the piston area in the wellbore exceeds the opposing pressure extended on that portion of the piston within the chamber 250, the piston will accelerate forward towards the dome portion of the plug.

The dome portion of the plug, with its equally spaced scores, is designed to break open when a certain force is applied thereto. With a breaking force established, the plug can be designed with the required acceleration of the piston and corresponding length of the piston stroke necessary to ensure the dome portion breaks open upon contact with the piston. For example, a dome portion having a certain score design thereupon and constructed of an aluminum material requires an energy of 15,000 lbs. in. to break open along the scores 210. The energy applied by the piston to this particular dome portion therefore, would necessarily have to exceed 15,000 lbs. in order to fully break open the plug. Determining the kinetic energy (Ek) of the piston requires the following calculations:

$$Ek=\tfrac{1}{2}\times M\times v^2 \tag{1}$$

where v=velocity at location of piston where it contacts the dome portion where M=mass of the piston where $$v^2=2\times a\times d \tag{2}$$

(assuming initial velocity of the piston is 0).

where d= acceleration length (distance traveled from rest to point where piston contacts the dome portion of the plug); and where a=acceleration of piston prior to contact between the piston and the plug.

and $$F=P\times A=M\times a \tag{3}$$

where F=Force applied to piston.

where P=Differential Pressure acting on the Piston.

where A=Annular area between surface 260 and 255.

rearranging equation (3) gives:

$$a=(P\times A)/M$$

substituting a=(P×A)/M into equation (2) gives:

$$v^2=2\times\{(P\times A)/M\}\times d$$

substituting $v^2=[2\times\{(P\times A)/M\}\times d$9 into equation (1) gives:

$$\begin{aligned} Ek &= 1/2\times M\times[2\times\{(P\times A)/M\}\times d] \\ &= 1/2\times M\times 2\times P\times A/M\times d \\ &= P\times A\times d \\ Ek &= 1{,}500 \text{ psi}\times 1.954 \text{ in}^2\times 6.099 \text{ in.} \\ &= 17{,}876 \text{ Lb in.} \end{aligned}$$

According the example above, the piston will have 17,876 lb in. of kinetic energy as it contacts the dome portion of the plug. Because the dome portion requires only 15,000 lb. in of energy in order to break open along the scores formed therein, the plug will open if a pressure of 1500 psi is applied to the piston area and the shear screws fail, allowing the piston to accelerate forward.

Figure 4:
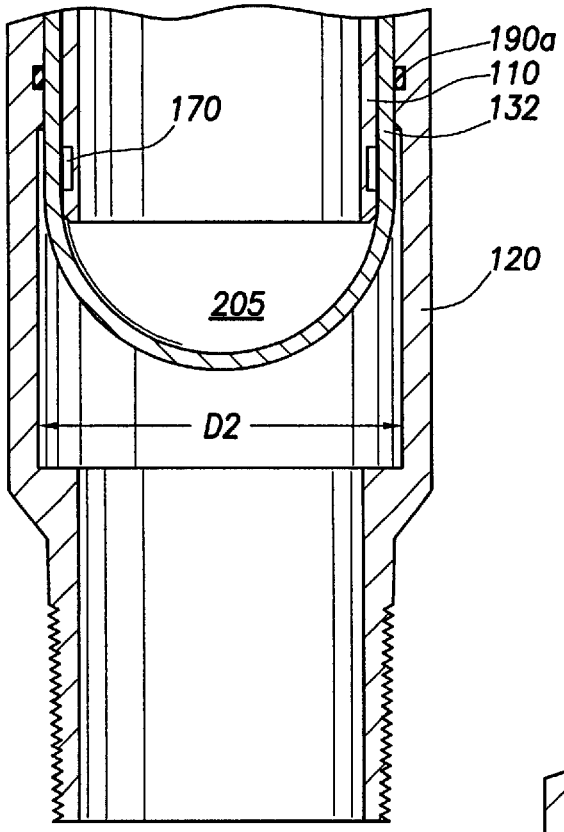
FIG. 4 is a side view, partially in section of the tubing plug of the present invention with the piston in initial contact with the dome-shaped portion of the plug.
Figure 5:
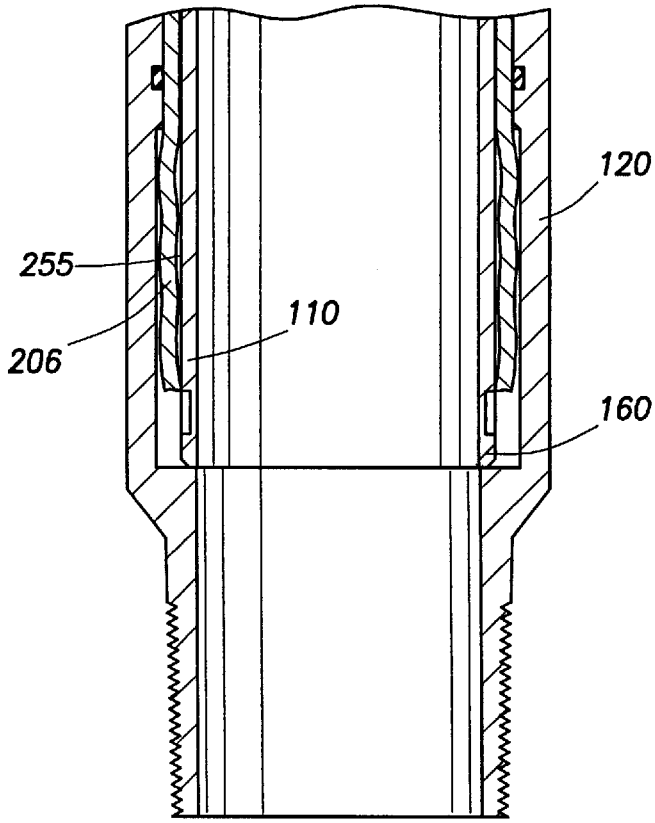
FIG. 5 is a side view, partially in section of the tubing plug with the piston having pierced the dome-shaped portion of the plug.

FIG. 4 shows the tubing plug 100 with the piston 110 in its initial contact position with the dome portion 205 of the plug 130. The second end of the piston 111, with its edge 160 is constructed and arranged to contact the concave side of the dome portion causing the dome portion 205 to break open along the scores 210 formed in its outside, convexed face. After the dome portion 205 breaks along the scores, the second end of the piston moves through the space previously occupied by the dome portion and pushes the attached pieces or petals 206 of the dome into the expanded inner diameter D2 of the plug body, where they are permanently held by the outer surface 255 piston 110. The hydrostatic differential between tubing pressure and the atmospheric pressure in the atmospheric chamber ensures the piston remains in its fully extended position. Additionally, the wedging action of the piston against the deformed petals 206 of the dome portion helps retain the piston in the extended position. FIG. 5 shows the tubing plug with the piston in its fully extended position. The bore of the plug is now completely open and will allow the passage of fluid or equipment in either direction.

Figure 6:
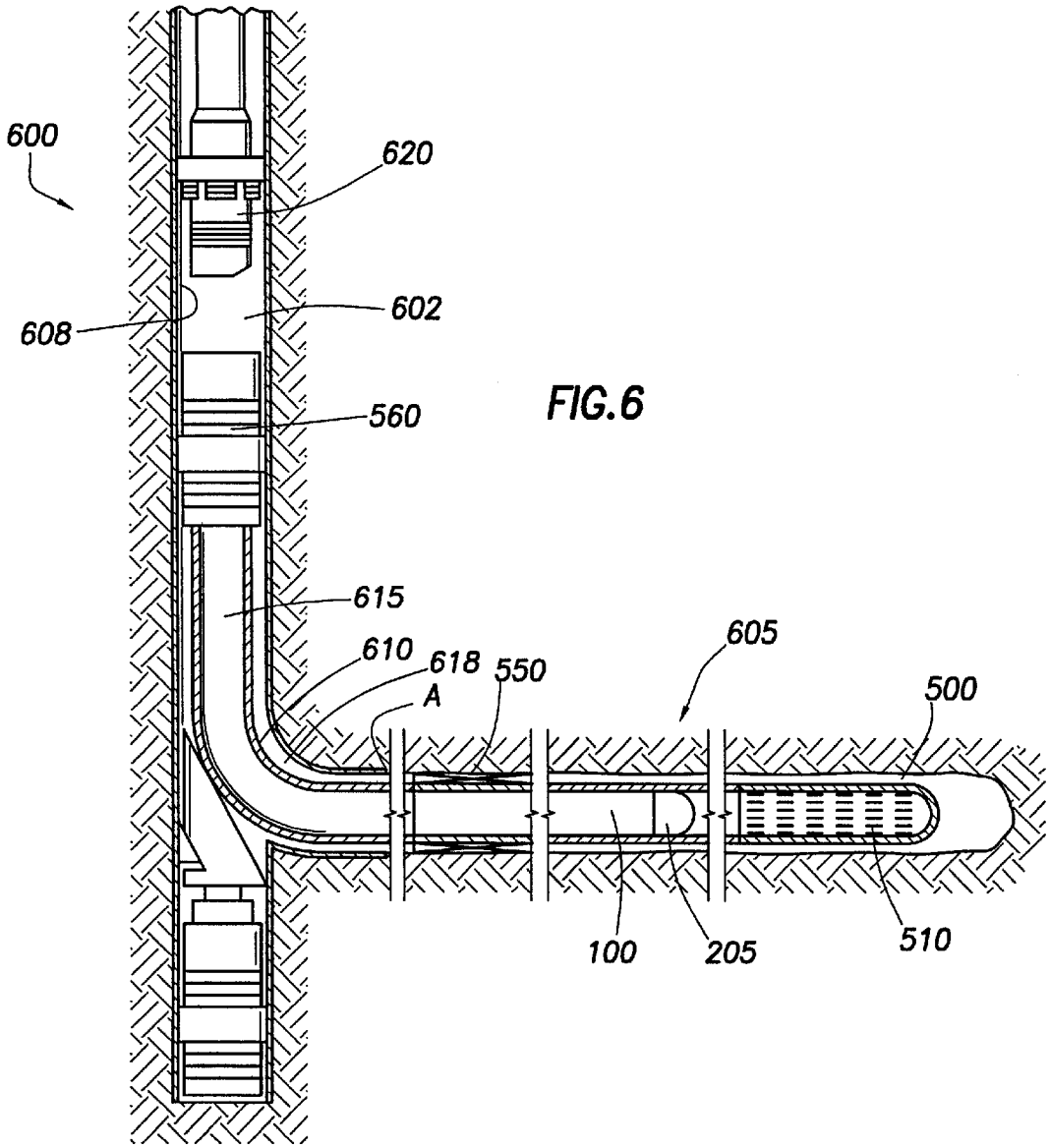
FIG. 6 is a view, partially in section of a wellbore including the tubing plug of the present invention.

FIG. 6 is a side view depicting the tubing plug 100 of the present invention installed in a well 600. The well consists of a bore 602 which, in FIG. 6 includes a horizontal portion 605. However, it will be appreciated by those skilled in the art that the plug of the present invention could be used in any well, horizontal or vertical. As the well is completed and intermediate casing 608 has been installed along the walls of the wellbore, a string of liner 610 with the tubing plug 100 of the present invention installed between two subsequent pieces of liner, is inserted into the wellbore. In the example shown in FIG. 6, the intermediate casing in the wellbore terminates at point "A" and thereafter the bore will be lined with the string of liner 610 including tubing plug 100. From the bottom of the wellbore, the liner string 610 includes a sand screen 500 having slots 510 to accept production fluid, the tubing plug 100 of the present invention installed adjacent the sand screen and, an inflatable packer 550. A liner top packer 560 is installed with running tool 620 at the top of the casing liner 610.

As the liner string 610 with the plug 100 is installed, the finer bore 615 above the plug is isolated from production fluid or drilling mud. The inflatable packer 550 located above the tubing plug 100 is inflated with pressure from the well surface and the annulus 618 between the liner string 610 and the intermediate casing 608 above the packer 550 can be isolated from fluid. Additionally, the annular area between the liner and the intermediate casing wall is further isolated by the liner top packer 560.

When the well is ready to produce and there is no longer a need to isolate the liner from well fluid, pressure is applied to the tubing plug 100 in the form of hydrostatic pressure in the liner above the plug and additional surface pressure applied from the well surface. As the combined pressure exceeds the resistance force of the shear screws (2,933 lbs. in the example herein), the shear screws 198 fail and the piston 110 accelerates forward, causing the dome portion 205 to break open and opening the liner bore to fluid flow in both directions.

Using a plug having mechanical features of the type described herein including a pressure differential between an atmospheric chamber and tubing pressure, the plug of the present invention can be designed to fit a variety of needs based on a customer's desires.

While foregoing is directed to the preferred embodiment of the present invention other and further embodiments of the invention may be devised without departing from the basic scope thereof, and the scope thereof is determined by the claims that follow. For example, the scores 210 formed on the dome potion 205 of the plug are designed to open when contacted by the edge 160 of the piston 110 with its grooved, tapered surface. Various arrangements are possible between the dome and the piston so long as the weakening formations of the dome are matched with formations on the edge of the piston. These choices of design are fully within the scope of the invention.

What is claimed is:

1. A plug for use in a well bore tubular string, comprising:

(a) a piston housing;

(b) a piston moveably mounted within the piston housing in a first, fixed position, the piston having a piston surface at a first end and a striking surface at a second end;

(c) a chamber formed between the piston and the piston housing;

(d) a plug disposed at a first end of the piston housing and openable in an outward direction whereby;

(e) when a pre-determined pressure is exerted on the piston surface, the piston travels from the first position to a second position, the striking surface of the piston striking the plug and thereby opening the plug.

2. The tubing plug of claim 1, wherein the piston is held in the first position by a frangible retainer mechanism.

3. The tubing plug of claim 2, wherein the frangible retainer mechanism includes a plurality of shear screws extending through the plug body and contacting an external surface of the piston.

4. The tubing plug of claim 3, wherein the shear screws fail when the predetermined pressure is exerted on the surface of the piston.

5. The tubing plug of claim 3, wherein the shear screws are accessible from the outside of the plug by threadedly separating the plug housing from the piston housing.

6. The tubing plug of claim 1, wherein the closed end of the plug forms an outwardly extending dome, the inside of the dome having a concave shape and the outside of the dome having a convex shape, the dome including an apex and a side.

7. The tubing plug of claim 6, wherein the outer surface of the dome includes a plurality of scores formed thereon, the scores facilitating a fracturing of the dome along the scores upon contact with the striking end of the piston.

8. The tubing plug of claim 7,wherein each score extends from the apex of the dome to the side of the dome.

9. The tubing plug of claim 8, wherein the scores are formed at a first depth at the apex of the dome and gradually reach a second, greater depth at the side of the dome.

10. The tubing plug of claim 7, wherein when the striking surface of the piston strikes the dome, the dome breaks along the scores, forming a plurality of broken pieces that remain connected to the dome plug at a first end and are unconnected at a second end.

11. The tubing plug of claim 10, wherein the broken pieces are retained within the plug housing.

12. A plug for use in a wellbore tubular string, comprising:

a housing with an annular piston slidably mounted in a first position therein and an atmospheric chamber formed therebetween;

a plug disposed at a first end of the housing, the plug comprising a frangible member; whereby when a predetermined pressure is exerted upon the piston, the piston travels to a second position, fracturing the frangible member and retaining the pieces of the plug in the housing.

* * * * *